United States Patent [19]

Bitoh

[11] Patent Number: 4,676,676

[45] Date of Patent: Jun. 30, 1987

[54] EMBOSSING IMPRINTER INCLUDING AN ELECTRONIC PRINTER

[75] Inventor: Hiroyasu Bitoh, Tokyo, Japan

[73] Assignee: Casio Computer Co., Ltd., Tokyo, Japan

[21] Appl. No.: 862,093

[22] Filed: May 12, 1986

[30] Foreign Application Priority Data

May 20, 1985 [JP] Japan ..... 60-108539

[51] Int. Cl.[4] ..... B41J 3/02

[52] U.S. Cl. ..... 400/120; 400/124; 101/269; 101/349; 101/375

[58] Field of Search ..... 101/268–269, 101/369, DIG. 10, DIG. 18, 349, 375; 400/120, 124; 235/379, 380; 346/76 PH

[56] References Cited

U.S. PATENT DOCUMENTS

| | | | |
|---|---|---|---|
| 4,068,213 | 1/1978 | Nakumura et al. | 101/DIG. 18 |
| 4,262,589 | 4/1981 | Gebhardt | 101/379 |
| 4,339,208 | 7/1982 | Biedermann | 400/124 |
| 4,492,484 | 1/1985 | Akazawa et al. | 400/124 |
| 4,564,846 | 1/1986 | Siegal | 400/126 |

FOREIGN PATENT DOCUMENTS

| | | | |
|---|---|---|---|
| 2133744 | 8/1984 | United Kingdom | 101/DIG. 18 |

*Primary Examiner*—E. H. Eickholt

*Attorney, Agent, or Firm*—Frishauf, Holtz, Goodman & Woodward

[57] ABSTRACT

An embossing imprinter includes an embossing transfer roller and a data print head. The embossing transfer roller is formed mechanically integrally with the data print head. The printing formats can be electronically modified.

8 Claims, 6 Drawing Figures

EMBOSSING IMPRINTER INCLUDING AN ELECTRONIC PRINTER

BACKGROUND OF THE INVENTION

1. Field of the Invention

The present invention relates to an embossing imprinter capable of electronically modifying print formats.

2. Description of the Prior Art

In recent years, there has been an increasing use of credit cards carrying machine readable coding identifying the cardholder's account and including further relevant information, including, in an encoded form, a Personal Identification Number (PIN) known to the cardholder but not appearing on the card in human readable form. Entry by a cardholder of his PIN in a machine equipped to read the encoded information of the card may be used to confirm a transaction in place of the usual requirement of a signed authorization.

Conventionally, such credit cards, are known as embossed cards on which the type of card, the cardholder's name, a membership number, and the like are imprinted by embossed characters and numerals. Upon credit sales of items in a store, credit cards are used to print sales slips, by means of an embossing imprinter.

When a credit card sales slip is imprinted by a conventional embossing imprinter, a sales date, a sales amount, and the like are manually set in the imprinter using data rings, and the date and amount are imprinted on the slip. The names of the stores (store names), the names of card issuers, and the like are imprinted on the slip by a corresponding embossed metal plate, which must be changed for each transaction.

However, in the conventional embossing imprinter with manually operable data rings, it is troublesome to preset the data rings, which include only a limited number of character types. For example, the data rings are constituted mainly by numeral types. In addition, the conventional imprinter has no flexibility for print positions, i.e., print formats. Furthermore, as stated above, when the store names, the names of card issuers, and the like are to be imprinted, embossed plates must be changed, resulting in troublesome operation.

The present invention has been made in consideration of the conventional drawbacks, and has as its object to provide an embossing imprinter which can imprint all the required data (e.g., sales date, sales amount, store name, name of card issuer, and the like) using numerals, the alphabet, and the like, without the use of data rings or embossed plates.

It is another object of the present invention to provide an embossing imprinter which can easily change print formats electronically.

It is still another object of the present invention to provide an embossing imprinter which can use IC cards as well as credit cards.

SUMMARY OF THE INVENTION

The objects of the invention are accomplished by providing an embossing imprinter comprising:

embossing transfer roller means for mechanically transferring at least one of characters and numbers embossed on a card to a paper-like material;

print head means formed integral with the embossing transfer roller means to constitute carriage means, for electronically printing out print data concerning a transaction, the carriage means being slidable between a home position and an opposite position in the embossing imprinter;

means for detecting present position of the print head means to derive a positional detection signal; and print control means for controlling the supply of the print data to the print head means in response to the positional detection signal, thereby printing out the print data on a predetermined printing area of the paper-like material.

BRIEF DESCRIPTION OF THE DRAWINGS

The invention may be best understood with reference to the accompanying drawings in which.

DETAILED DESCRIPTION OF THE PREFERRED EMBODIMENT

ARRANGEMENT OF EMBOSSING IMPRINTER

Figure 1:
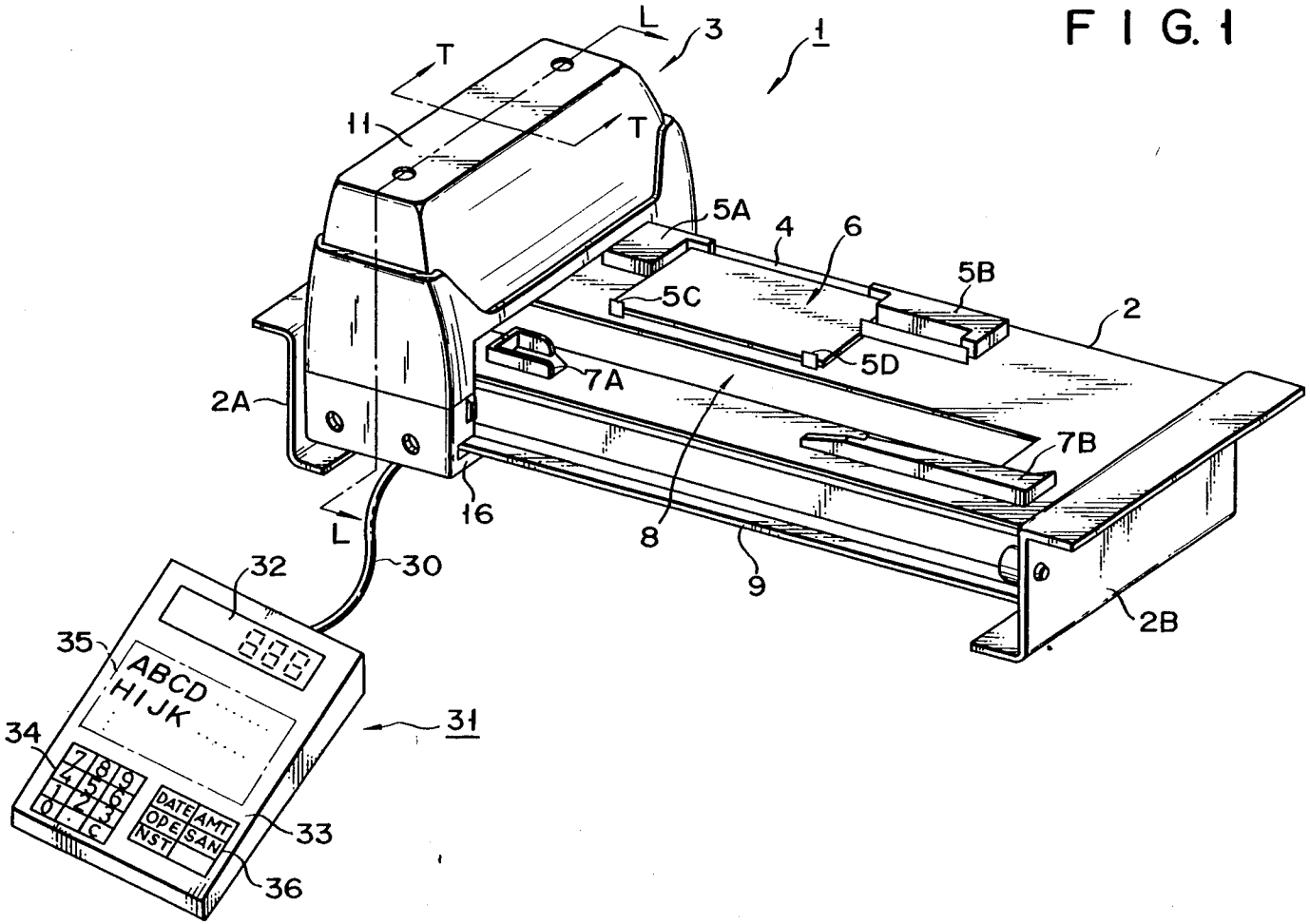
FIG. 1 is a perspective view of an embossing imprinter according to one preferred embodiment.

The arrangement of an embossing imprinter according to an embodiment of the present invention will now be described with reference to FIGS. 1 and 2. Referring to FIG. 1, a housing 2 has side frames 2A and 2B at its both end portions. A carriage 3 is slidable along housing 2. Card mount 4 is formed on the upper surface of housing 2. Card mount 4 defines the mounting position of credit card 6 using four stoppers 5A to 5D provided on four corners thereof.

A normal magnetic card with embossed characters/-numerals or an IC card (i.e., a card incorporating an IC module) can be used as credit card 6.

Stoppers 7A and 7B for defining the mounting position of a sales slip (not shown) are formed on the upper surface of housing 2, on a side opposite to stoppers 5A and 5B. In this case, stopper 5A also serves as a stopper for the sales slip (not shown), thus defining the mounting position of the slip with stoppers 5A, 7A, and 7B. Window 8 for a printer head is formed between card mount 4 and stoppers 7A and 7B on the upper surface of housing 2. Guide rails 9 for guiding carriage 3 are provided on both lower side portions of housing 2.

Figure 2A:
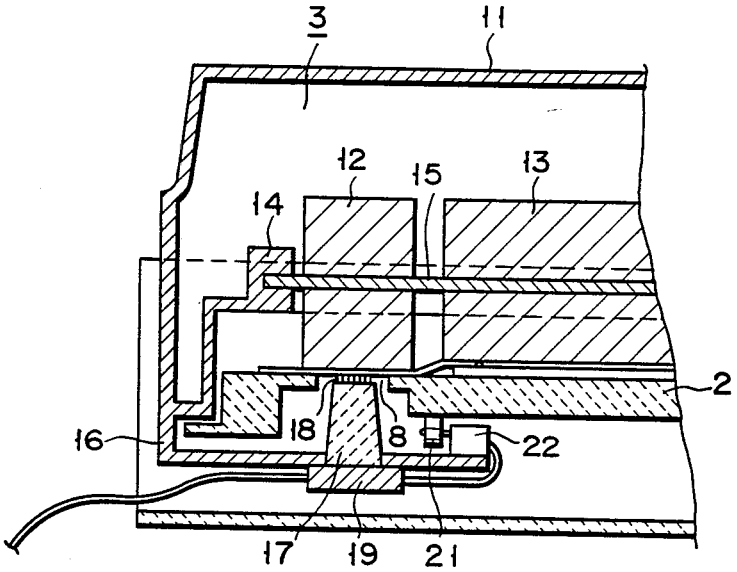
FIG. 2A is a sectional view taken along a longitudinal axis L—L of the carriage case of FIG. 1.
Figure 2B:
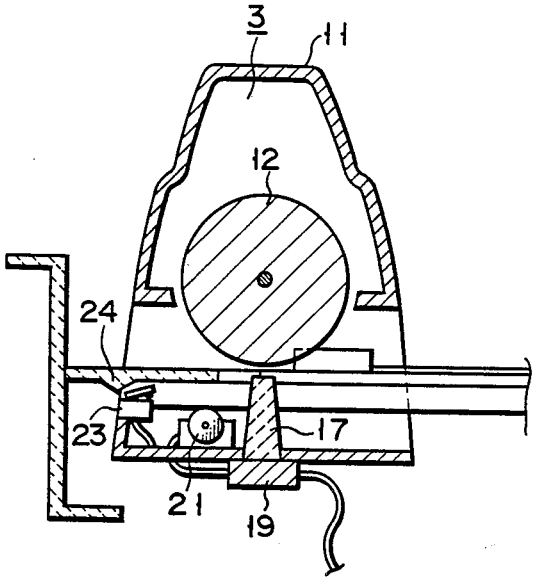
FIG. 2B is a cross-sectional view taken along a transverse line T—T of the carriage case of FIG. 1.

FIG. 2A is a sectional view taken along line L—L of carriage 3 of embossing imprinter 1 in FIG. 1, and FIG. 2B is a cross-sectional view taken along line T—T of carriage 3.

As shown in FIGS. 2A and 2B, carriage 3 includes platen 12 filled with ink, and embossing transfer roller 13 in its case 11. Platen 12 and roller 13 are pivotally journaled on shaft 15 supported by bearing 14. In this case, platen 12 is arranged above window 8, whereas roller 13 is arranged to oppose to card mount 4 (See FIGS. 1 and 2A). One side portion of case 11 extends below the lower surface of housing 2 to serves as arm 16. Print head 17 is mounted on arm 16 positioned below platen 12 through window 8. Print head 17 includes a wire-matrix printer, and has 9-dot linear electrode 18 parallel to shaft 15 of platen 12. Head 17 is connected to printer controller 19 mounted on arm 16. Carriage 3 further includes position detector 22 consisting of position detecting roller 21. Roller 21 contacts the lower surface of housing 2, and is rotated when carriage 3 moves. A pulse generator (PG) of position detector 22 generates pulses upon rotation of roller 21 and counts the pulses to detect the position of carriage 3, as will be described later. Carriage 3 also has limit switch 23, which contacts the lower surface of housing 2 and is connected to detector 22. Projection 24 (see FIG. 2B) is provided on the lower surface of housing 2, and abuts against a lever of switch 23 to turn it on when carriage 3 is at its home position (i.e., the position shown in FIG. 1).

SYSTEM CONTROLLER

Printer controller 19 is connected to system controller 31 through cable 30. System controller 31 includes display section 32 and key entry section 33 on its upper surface. Key entry section 33 consists of number entry keys 34, alphabet keys 35, and function keys 36 for inputting, e.g., date data (DATE), operator data (OPE), store name data (NST), total amount data (AMT), sales approval number data (SAN), and the like.

Figure 3:
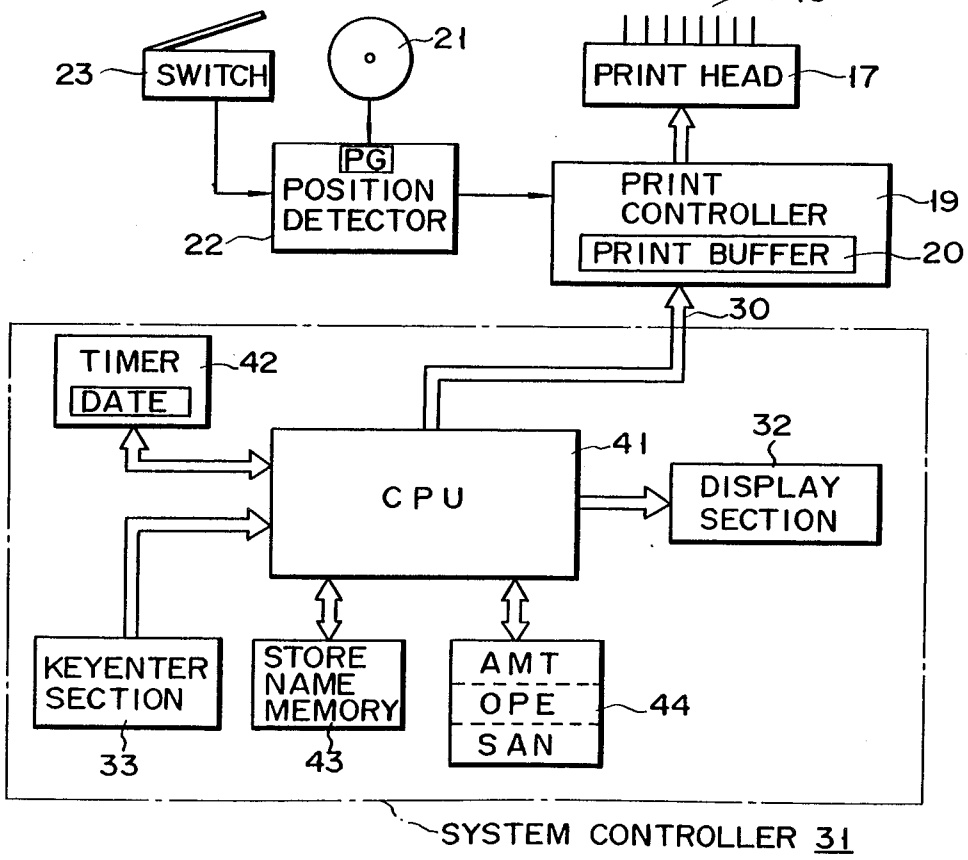
FIG. 3 is a block diagram of a system controller in conjunction with peripherals of the imprinter shown in FIG. 1.

As shown in FIG. 3, system controller 31 comprises CPU (central processing unit) 41, which is connected to timer unit 42, store name memory 43, and data memory 44, as well as sections 32 and 33. Data memory 44 stores total amount data (AMT), operator data (OPE), sales approval number data (SAN), and the like. CPU 41 transfers print data to printer controller 19 through cable 30. Print controller 19 includes print data buffer 20 for storing print data from CPU 41, and transfers the print data to print head 17 in accordance with the position signal from the pulse generator of detector 22.

OPERATION OF EMBOSSING IMPRINTER

The operation of the embossing imprinter of this embodiment will now be described. Upon use of embossing imprinter 1, the name of a store (in alphabet) is input from section 33 of print controller 31 to be stored in store name memory 43, and an operator's name is also stored in data memory 44 through section 33. Timer unit 42 in controller 31 continuously counts current time, to supply current date data to CPU 41.

Carriage 3 of embossing imprinter 1 is normally located at the home position on the frame 2A side (viewed in FIG. 1). In this state, the lever of switch 23 is pushed against projection 24 formed on the lower surface of housing 2 to turn switch 23 on. When switch 23 is in the ON state, position detection data in detector 22 is cleared to initialize it.

On a transaction, customer's credit card 6 is placed on card mount 4, and a sales slip is set in the predetermined position, as described previously. Sales amounts of items purchased are sequentially input from key entry section 33 of controller 31. The sales amounts of the items are then added by CPU 41, and total amount data (AMT) is written in data memory 44. The sales amounts are supplied from CPU 41 to display section 32 and displayed thereon. After calculation of the total amount, CPU 41 calculates sales approval number data (SAN) with reference to total amount data (AMT), date data (DATE), and the like, and writes it into memory 44. CPU 41 then transfers date data (DATE) from timer unit 42, total amount data (AMT), operator data (OPE), and sales approval number data (SAN) stored in memory 44, and store name data (NST) stored in memory 43 to printer controller 19, to temporarily store them in print data buffer 20.

After the inputting of the sales amounts of the items, the operator holds carriage 3 and moves it until it abuts on side frame 2B opposite to the home position side (the frame 2A side) to print the above data on the sales slip. After the printing operation, the operator returns carriage 3 to the home position.

When carriage 3 is moved from the home position, limit switch 23 is released to be turned off, thus cancelling the cleared state of detector 22. Upon movement of carriage 3, roller 21 is rotated. Detector 22 counts the pulses generated upon rotation of roller 21 to detect the position of carriage 3, and transfers the position data to printer controller 19. Controller 19 then reads out the data from print data buffer 20 in accordance with the position data of carriage 3 from detector 22, and drives print head 17 to print data at predetermined positions on the sales slip.

Figure 4:
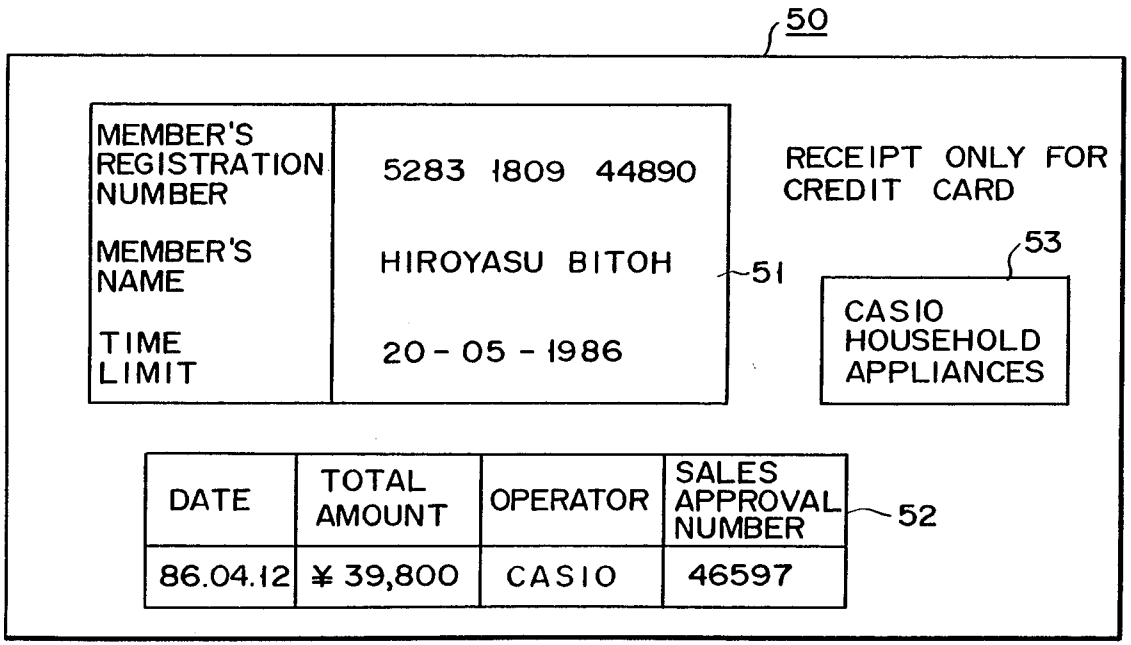
FIG. 4 illustrates a receipt processed by the embossing imprinter shown in FIG. 1.

FIG. 4 shows an example of printed receipt 50 passed to a customer. Receipt 50 is set on embossing imprinter 1 together with the sales slip. Therefore, the predetermined data is imprinted on receipt 50 by embossing imprinter 1. After the printing operation, receipt 50 is separated from the sales slip by the operator and is given to the customer. The sales slip is kept in the store. First printing area 51 of receipt 50 is printed by the embossed portion of credit card 6, and second and third printing areas 52 and 53 are electronically printed by print head 17. On receipt 50, frames and predetermined characters are electronically printed on first to third printing areas 51 to 53 in advance in a predetermined format, and printing is performed within the predetermined areas by the embossed portion of card 6 and print head 17. In the example of FIG. 4, a date, a total amount, a name of an operator, and a sales approval number are printed in second printing area 52, and a store name is printed in third printing area 53. When carriage 3 is returned to the home position after the printing operation, the lever of switch 23 abuts against projection 24 to be turned on, thus initializing detector 22. Thus, a transaction with credit card 6 is completed.

MODIFICATION

Next, an embodiment in which IC card 60 is used instead of credit card 6 will be described, with reference to FIG. 5.

Figure 5:
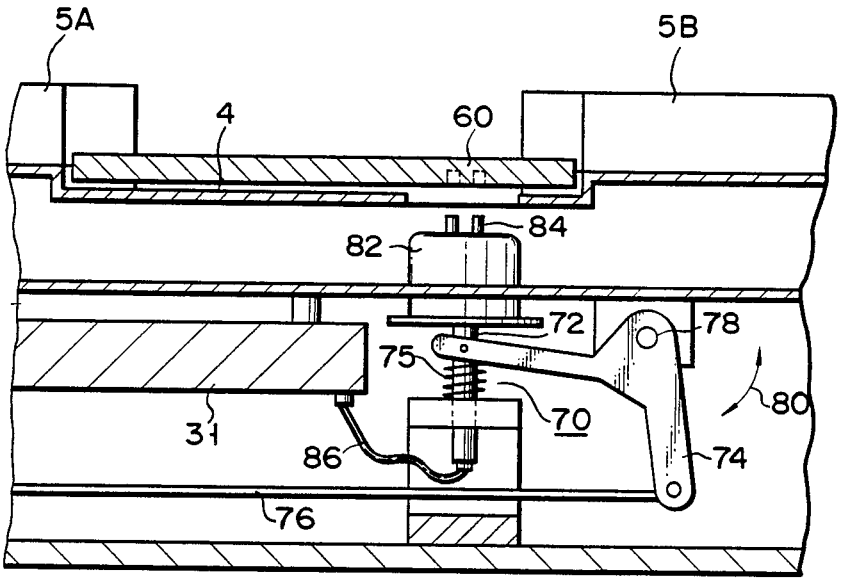
FIG. 5 is a sectional view for partially illustrating electrical and mechanical connection between an IC card and a terminal mechanism.

FIG. 5 is a sectional view taken along a direction parallel to window 8 of embossing imprinter 1. The same reference numerals in FIG. 5 indicate the same parts as in FIG. 1.

IC cards generally have contacts for electrically connecting an installed IC module and an external processing device (e.g., a card terminal). These contacts and the external processing device (in this embodiment, terminal mechanism 70 for connecting card 60 and CPU 41) are installed in housing 2 below card mount 4. Actuating shaft 72 is biased against terminal mechanism 70 by spring 75. Shaft 72 is pivotally mounted on one end of lever 74. Since wire 76 is coupled to the other end of lever 74, lever 74 can pivot about pivot shaft 78, in the direction indicated by arrow 80. Thereby, actuating shaft 72 of mechanism 70 can be moved vertically. Terminal section 82 is provided at the distal end of shaft 72, and contact terminals 84 of section 82 can be vertically moved when shaft 72 is moved, so that when carriage 3 is translated from the home position and then wire 76 is drawn in the left direction, contact terminals 84 are electrically connected to the contact terminal of IC 60.

In the state of FIG. 5, contact terminals 84 are located at their lower position, to be separated from contacts of IC card 60 (not shown in detail). Terminals 84 are connected to system controller 31 through cable 86.

The operation for an IC card will now be briefly described. IC card 60 is placed on card mount 4 and lever 74 is pivoted in the upward direction of arrow 80 when carriage 3 is slid from the home position, thereby electrically connecting terminals 84 to the contacts of card 60. Subsequent operation is the same as that for a normal IC card, and a detailed description thereof is omitted.

It is apparent that when IC card 60 is used, printing by the printer can be performed as well as that by the embossing section in the same manner as in the embodiment using credit card 6.

A main feature of the present invention can be summarized as follows.

Since the embossing transfer roller and the data print head can be moved mechanically integrally with each other, the moving position of the print head can be electrically detected to output desirable print data. Therefore, print data (e.g., numerals, alphabets, and the like) can be desirably selected, and can be electronically printed on a sales slip in a desired print format.

In other words, in a conventional embossing imprinter, the data to be printed out is previously fixed and an overall operation is cumbersome. In contrast to this, with the embossing imprinter of the present invention, since the print data can be electronically processed, the content of the print data can be selected as desired. Since the embossing transfer roller and the print head are integrally slidable, both an ordinary credit card and an IC card can be used, in addition to the above advantages of the invention.

While the invention has been described in terms of a specific embodiment, and exemplified with respect thereto, those of skill in the art will readily appreciate that various modification, changes, omissions, and substitutions may be made without departing from the spirit of the invention. For example, a printer mechanism is not limited to a wire-matrix printer, but can be a thermal dot-matrix printer. In the above embodiment, print head 17 is provided below the sales slip, but can be arranged thereabove.

In the previous embodiment, the home position of the carriage is detected by the limit switch and projection. It is also possible to detect such a position by the normal noncontact type detector, e.g., an optical sensor, a magnetic sensor and the like.

According to the present invention as described above, the embossing transfer roller and the data print head are moved integrally with each other, and the moving position of the print head is detected to output print data. Therefore, an embossing imprinter can be provided in which print data (e.g., a date, a sales amount, the name of a store name, the name of a card issuer and the like) can be printed in numerals, alphabets, and the like, without requiring setting of data rings or changing of embossing plates, and the print format can be changed as desired.

What is claimed is:

1. An embossing imprinter comprising:

embossing transfer roller means for mechanically transferring at least one of characters and numbers embossed on a card to a paper-like material;

print head means formed integral with the embossing transfer roller means to constitute carriage means, for electronically printing out print data concerning a transaction, said carriage means being slidable between a home position and an opposite position in the embossing imprinter;

means for detecting present position of the print head means to derive a positional detection signal; and print control means for controlling the supply of the print data to the print head means in response to the positional detection signal, thereby printing out the print data on a predetermined printing area of the paper-like material.

2. An imprinter as claimed in claim 1, wherein said position detecting means includes:

a position detecting roller rotatable in response with the transfer of the carriage means; and a pulse generator for generating a pulse train representing the present position of the carriage in conjunction with the rotation of the position detecting roller.

3. An imprinter as claimed in claim 1, further comprising:

noncontact type detector means for detecting whether the carriage means is located at the home position or not by utilizing at least one of optical phenomenon and magnetic phenomenon.

4. An imprinter as claimed in claim 1, further comprising:

a projection formed on a housing of the embossing imprinter; and a limit switch provided at the home position of the carriage means and pressed by the projection when the carriage means is at the home position.

5. An imprinter as claimed in claim 1, further comprising:

a platen filled with ink positioned opposite to the print head means, whereby said paper-like material is sandwiched between the platen filled with ink and the print head means ready for the printing operation.

6. An imprinter as claimed in claim 1, further comprising:

a terminal mechanism having contact terminals and positioned under the card; and a lever mechanically connected to the terminal mechanism, whereby said contact terminals are electrically communicated with electronic components of the card when the terminal mechanism is moved to the card by means of the lever action.

7. An imprinter as claimed in claim 1, wherein said print head means is a wire-matrix printer.

8. An imprinter as claimed in claim 1, wherein said print head means is a thermal dot-matrix printer.

* * * * *